US011686557B2

(12) United States Patent
Johnson et al.

(10) Patent No.: US 11,686,557 B2
(45) Date of Patent: Jun. 27, 2023

(54) COMPLIANT SINGLE NET MARINE BARRIER

(71) Applicant: HALO Maritime Defense Systems, Inc., Newton, NH (US)

(72) Inventors: Eric G. Johnson, Danvers, MA (US); Michael J. Osienski, Londonderry, NH (US); Barret Wolber, Newton, NH (US); Sean Gribbin, Newton, NH (US); Judson DeCew, East Kingston, NH (US)

(73) Assignee: HALO Maritime Defense Systems, Inc., Newton, NH (US)

( * ) Notice: Subject to any disclaimer, the term of this patent is extended or adjusted under 35 U.S.C. 154(b) by 43 days.

(21) Appl. No.: 17/350,819

(22) Filed: Jun. 17, 2021

(65) Prior Publication Data

US 2021/0396498 A1 Dec. 23, 2021

Related U.S. Application Data

(60) Provisional application No. 63/041,585, filed on Jun. 19, 2020.

(51) Int. Cl.
*F41H 11/05* (2006.01)
*E02B 3/20* (2006.01)

(52) U.S. Cl.
CPC ..... *F41H 11/05* (2013.01); *E02B 3/20* (2013.01)

(58) Field of Classification Search
CPC combination set(s) only.
See application file for complete search history.

(56) References Cited

U.S. PATENT DOCUMENTS

| | | | |
|---|---|---|---|
| 1,158,555 | A | 11/1915 | Prescott |
| 1,278,970 | A | 9/1918 | Maxwell |
| 1,299,243 | A | 4/1919 | Sheransky |
| 2,041,662 | A | 5/1936 | Mapes |
| 2,693,161 | A | 11/1954 | Stubbs |

(Continued)

OTHER PUBLICATIONS

International Search Report and Written Opinion of the International Searching Authority dated Sep. 23, 2021 in PCT/US2021/037873.

(Continued)

*Primary Examiner* — Kyle Armstrong
(74) *Attorney, Agent, or Firm* — Studebaker & Brackett PC

(57) ABSTRACT

A floating marine barrier is provided whose main components all have substantially equal elastic characteristics, enabling the barrier to better absorb and arrest an impacting vessel. Embodiments include a floating marine barrier including barrier modules each having a flotation device, a supporting framework attached to the flotation device, and impact net support posts attached to the supporting framework. An impact net is attached to each of the support posts and extends between the barrier modules along a longitudinal axis of the barrier; and a main tension strength element is attached to each of the barrier modules and extends between the barrier modules along the longitudinal axis of the barrier to space the barrier modules from each other. The impact net has a first elasticity, and the first main tension strength element has a second elasticity which is substantially equal to the first elasticity.

20 Claims, 20 Drawing Sheets

(56) References Cited

U.S. PATENT DOCUMENTS 2,716,959 A 9/1955 Betts, Jr. et al.
3,020,567 A 2/1962 Colt
3,077,614 A 2/1963 Lloyd
3,185,445 A 5/1965 Broadway
3,499,291 A 3/1970 Mikkelsen
3,604,389 A 9/1971 Roberts et al.
3,823,680 A 7/1974 Straumsnes
3,864,049 A 2/1975 Ono
4,033,137 A 7/1977 Geist
4,073,143 A * 2/1978 Preus ..... E02B 15/085 405/72
4,174,185 A 11/1979 Toki
4,272,214 A 6/1981 Nyfeldt et al.
4,319,858 A 3/1982 Jaffrennou et al.
4,425,053 A 1/1984 Muto et al.
4,529,388 A * 7/1985 Jones ..... B63B 22/02 114/230.11
5,062,739 A 11/1991 Klockner
5,141,359 A 8/1992 Klockner
5,179,907 A 1/1993 Galbraith
5,429,452 A 7/1995 Frost
5,433,549 A * 7/1995 McGaffigan ..... A63H 33/042 403/41
5,651,709 A 7/1997 Nandakumar et al.
5,827,011 A 10/1998 Kann
5,980,159 A 11/1999 Kazim
6,102,616 A 8/2000 Foote
6,591,774 B2 7/2003 Metherell et al.
6,655,641 B2 12/2003 Sherman et al.
6,681,709 B1 1/2004 Nixon et al.
6,843,197 B1 1/2005 Nixon et al.
6,860,209 B2 3/2005 McKoy
6,877,456 B2 4/2005 Metherell et al.
6,886,484 B2 5/2005 Thomas
6,960,047 B2 11/2005 Knezek et al.
6,980,483 B2 12/2005 McDonald
7,140,599 B1 11/2006 Spink
7,401,565 B2 7/2008 Nixon et al.
7,451,527 B2 11/2008 Pearce et al.
RE40,616 E 1/2009 Nixon et al.
7,481,176 B2 1/2009 Pratt et al.
7,524,139 B2 4/2009 Bishop
7,524,140 B2 4/2009 Bishop
7,572,083 B1 8/2009 Bishop et al.
7,726,910 B2 6/2010 Foo et al.
7,744,313 B2 6/2010 Terai et al.
7,887,254 B2 2/2011 Bishop
7,975,639 B2 7/2011 Bishop
8,007,202 B2 8/2011 Davis et al.
8,020,836 B2 9/2011 Bishop
8,844,114 B2 9/2014 Butterfield
8,920,075 B2 12/2014 Bishop
9,683,342 B2 6/2017 Bishop
2003/0190191 A1 10/2003 Clark
2004/0018055 A1 1/2004 Clark et al.
2004/0018060 A1 1/2004 Knezek et al.
2004/0115002 A1 6/2004 Meeks et al.
2005/0013668 A1 1/2005 Nixon et al.
2005/0058509 A1 3/2005 Steinberg
2005/0191129 A1 9/2005 Yodock et al.
2006/0034668 A1 2/2006 Knezek et al.
2006/0037526 A1 2/2006 Knezek et al.
2006/0216116 A1 9/2006 Baker et al.
2007/0102689 A1 5/2007 Alberson et al.
2008/0105184 A1 5/2008 Nixon et al.
2008/0267717 A1 10/2008 Meyers et al.
2008/0279631 A1 11/2008 Bishop
2009/0035068 A1 2/2009 Terai et al.
2009/0090059 A1 4/2009 Bishop
2010/0059728 A1 3/2010 Bishop
2010/0178109 A1 7/2010 Wilson
2010/0239374 A1 9/2010 Davis et al.
2011/0227731 A1* 9/2011 Iffergan ..... F41H 11/05 114/294
2012/0076590 A1* 3/2012 Bruder ..... E02B 15/08 405/211
2012/0121342 A1 5/2012 Utz et al.
2013/0108368 A1 5/2013 Bishop
2013/0119334 A1 5/2013 Bishop
2019/0137225 A1 5/2019 Terai et al.
2020/0116458 A1 4/2020 Knezek et al.
2021/0114700 A1 4/2021 Osienski et al.

OTHER PUBLICATIONS

International Preliminary Reporton Patentability issued in PCT/US2021/037873; dated Dec. 13, 2022.

* cited by examiner

COMPLIANT SINGLE NET MARINE BARRIER

RELATED APPLICATIONS

The present application claims priority from U.S. Provisional Application 63/041,585, filed Jun. 19, 2020, entitled "Compliant Single Net Marine Barrier," which is hereby incorporated by reference in its entirety.

TECHNICAL FIELD

The present subject matter relates to marine barriers and movable gates. The present disclosure has applicability to floating barrier systems, and more particularly to a compliant single net marine barrier and gate system.

BACKGROUND

The disclosed embodiments herein improve upon conventional marine barriers. The function of these systems is based upon a single capture net, which must elongate a considerable amount in order to arrest the kinetic energy of accidental or intentional impact by vessels. The conventional approach of such marine barriers is to mount the vessel capture net to rigid structures. However, the considerable elongation required of the capture net is not physically possible for the rigid structures of those systems. This conventional approach is disadvantageous because the 3-dimensional system of structure and net needs to be compliant to suitably conform to wave forms, allow for flexible maneuvering of the barrier when used as a gate, and to actually elongate as required to arrest the kinetic energy of a vessel speeding into it. Furthermore, conventional marine barriers characterized by long rigid segments with mounted deformable capture nets and connected by short chain assemblies encased in elastomer, as described in several U.S. patents, cannot work as claimed due to the large differences in elastic behavior of each part of those barriers.

Legacy Barriers and Their Design Limitations

In conventional marine barriers, the capture net system (i.e. the impact net(s)) is the primary means of preventing breach of the barrier. Typically, the impact nets are secured to vertical posts or beams that are rigidly mounted to the main lengthwise structural elements and cannot move relative to the base floatation structure. See, for example, U.S. Pat. No. 6,681,709 (hereinafter "the '709 patent") at FIGS. 5-7, illustrating a steel structure and nylon capture net. Barrier segments are typically fabricated in set lengths (e.g., 40 ft, 50 ft, etc). This type of structure is disadvantageous because it does not allow for adjustment of spacing between discrete parts of the barriers; e.g., to "tune" the barriers to site-specific environmental and performance requirements. Connection between conventional barrier segments is accomplished by a variety of methods; for example, using tethers (rope and/or chain), or a chain reinforced flexible elastomer such as a rubber joint, or a mechanical joint such as a pin or "door hinge" type connection. Conventional capture nets are mounted via rigid posts near or adjacent to these short flexible joints, and are continuous across the joints and from segment to segment. Because a significant portion of barrier motion is resolved at these short-jointed locations, the net is subjected to high loads (dynamic strain) in extreme wave events. This significantly reduces the service life of the capture net and results in nets frequently becoming torn away from the nearest net posts.

Additionally, in conventional barriers, the capture net is continuous over the length of the barrier, up to where the barrier is connected to buoys. More particularly, the capture net is fixed to the ends of barrier segments just prior to where the barriers are connected to buoys. Thus, a single point of connection exists where those barriers are connected to buoys. Disadvantageously, the single point of connection must carry environmental storm loads and loads from the capture net. The resulting single connection component is often very heavy, and difficult to operate in rough weather. As a result, conventional marine barrier gates, such as those currently in use by the U.S. Navy and described in the '709 patent, are often left secured by a single dock line rope, called a "soft close," which does not provide any significant threat deterrence. The present disclosure describes a marine barrier and gate system wherein the capture net connections and the main barrier connections are separate.

Conventional barrier systems employ short flexible connection elements along the center axis of the barrier, in line with the rigid structural elements. The design of the system is predicated upon manufactured units of fixed consistent (i.e., non-adjustable) length. Thus, the ability to optimize the flotation requirements (hydrostatics and hydrodynamics) at the site assembly stage for select environments or site-specific conditions is absent. Furthermore, conventional barrier systems do not allow for component removal and replacement in-situ while maintaining system connectedness. The present disclosure provides for in-situ removal and replacement of any single component of the system while maintaining overall system connectedness.

As discussed immediately above, conventional barrier systems typically feature an elastically deformable capture net attached to inelastic rigid barrier segments interconnected with short chain-based flexible connectors. During an impact event, the difference in elastic modulus of these components disadvantageously results in the capture net breaking free from one of the rigid segments and elongating within the rigid length of the segment. As described in the '709 patent, these nets are expected to elongate two or three boat lengths in the area of the impact. In practice, the feasibility of capture nets elongating that amount is limited by the presence of the rigid inelastic barrier structure in the same space. This difference in component stiffness results in either the segment's rigid structures dominating the dynamics of the impact event (hence the nets do not functionally contribute), or the rigid barrier structure coming apart (i.e., failing), not being present, or otherwise disappearing from the impact area before the capture nets actually elongate and work as designed to deform, elongate and absorb the energy of the impacting vessel.

SUMMARY OF THE DISCLOSURE

An alternative to the foregoing disadvantageous scenarios is to have a barrier system wherein the capture nets and main tension strength elements work in tandem as an elastic system. The disclosed systems provide a better match of elongation of their main tension strength elements with elongation of the capture net, allowing the barrier system to better absorb and arrest an impacting vessel.

The present disclosure further includes improvements to the interconnectedness between floating barrier modules, enabling easy adjustment of module spacing of the disclosed systems, modularity of the base flotation elements, and performance enhancements of the net capture system. The combination of these improvements results in a compliant barrier system with uniform elastic behavior, enabling distribution of storm or crash energy to many system elements. Herein, the term "compliant" refers to elastic behavior in all directions. This compliant design can be scaled up or down, for optimization in cost relative to the security requirements and environment in which it operates.

Herein the term "elasticity" is used to describe the system's or components' compliance and pliability as a behavior or trait. Thus, "elasticity" as used herein is defined as a behavior where a loaded, deformed component returns to its undeformed shape once the loading is removed, or where the loaded, deformed component remains in its deformed (loaded) shape to a certain extent when the loading is removed.

The capture net systems of conventional marine barriers cannot function as a system of components, since their components' elasticities are different by orders of magnitude. The ratio of lengthwise rigidity to short length flexible sections can cause wear and a stress/load concentration in places where the barrier motion is resolved (i.e., at connection points between barrier segments). Embodiments of the disclosed systems feature a balanced ratio of rigid to flexible section lengths, significantly improving barrier performance. The disclosed embodiments have design features that enable the components of the compliant marine barrier and gate to function with elastic uniformity in operation, and to not over stress components when subjected to high wave dynamic motion and loads.

The disclosed system improves upon conventional technology and can be utilized in a variety of configurations to resolve the significant cost of on-water maintenance operations. The disclosed barriers are easily optimized for site-specific requirements by allowing the axial positioning of the barrier module floats to be easily adjusted along the length of the barrier. The disclosed design features a versatile flotation module that can be mounted, altered, and swapped in-situ if needed. Also, in certain embodiments the disclosed barrier flotation modules enable dual main tension lines for redundancy in performance, and singular replacement of either main tension line with the remaining line retaining system connection. Furthermore, in some embodiments the system connections are operationally improved with a four-sided mooring connection buoy, enabling 90-degree corner designs and secondary divider lines within a protected barrier perimeter.

Thus, the present disclosure enables variability in the placement of float modules of its barrier systems, and a significantly different ratio of flexible length to rigid length when compared to conventional barrier systems.

Embodiments of the present disclosure include a floating marine barrier comprising a plurality of barrier modules, each barrier module having a first flotation device, a supporting framework attached to the first flotation device, and a plurality of impact net support posts attached to the supporting framework; an impact net attached to each of the support posts of each of the barrier modules and extending between the barrier modules along a longitudinal axis of the barrier from a first end of the barrier to a second end of the barrier; and a first main tension strength element attached to each of the barrier modules and extending between the barrier modules along the longitudinal axis of the barrier from the first end of the barrier to the second end of the barrier to space the barrier modules from each other. The impact net has a first elasticity, and the first main tension strength element has a second elasticity which is substantially equal to the first elasticity. When the barrier is floating in a body of water and a moving vessel impacts the impact net, the impact net deflects to transfer a force of the impact to at least one of the net support posts and to one or more of the barrier modules, which in turn engages the first main tension strength element and the water to transfer the force of the impact to the main tension strength element and the water to arrest the motion of the vessel.

The present disclosure includes methods and designs for capture net connections which are improvements over conventional barriers. Embodiments include a separate net connection from the main barrier rope connection, to transfer impact loads up and over mooring buoy connections, resulting in effective capture net performance even if an impact occurs near a mooring buoy connection. This continuous connection is augmented by an optional additional wrap-around line at the top line of the capture net. Thus, if a cut-through or failure of the net's top line occurs during an impact, there is a redundant line present with capacity to take up the load of the rated impact.

Objects and advantages of embodiments of the disclosed subject matter will become apparent from the following description when considered in conjunction with the accompanying drawings. Additionally, the different configurations discussed in the sections below may be performed in a different order or simultaneously with each other. Furthermore, the disclosed systems of marine barriers and gates can be scaled up or down in size to suit security, site environmental, and customer cost requirements.

BRIEF DESCRIPTION OF THE DRAWINGS

Embodiments will hereinafter be described in detail below with reference to the accompanying drawings, wherein like reference numerals represent like elements. The accompanying drawings have not necessarily been drawn to scale. Where applicable, some features may not be illustrated to assist in the description of underlying features.

DETAILED DESCRIPTION

It should be understood that the principles described herein are not limited in application to the details of construction or the arrangement of components set forth in the following description or illustrated in the following drawings. The principles can be embodied in other embodiments and can be practiced or carried out in various ways. Also, it is to be understood that the phraseology and terminology used herein is for the purpose of description and should not be regarded as limiting.

Figure 1:
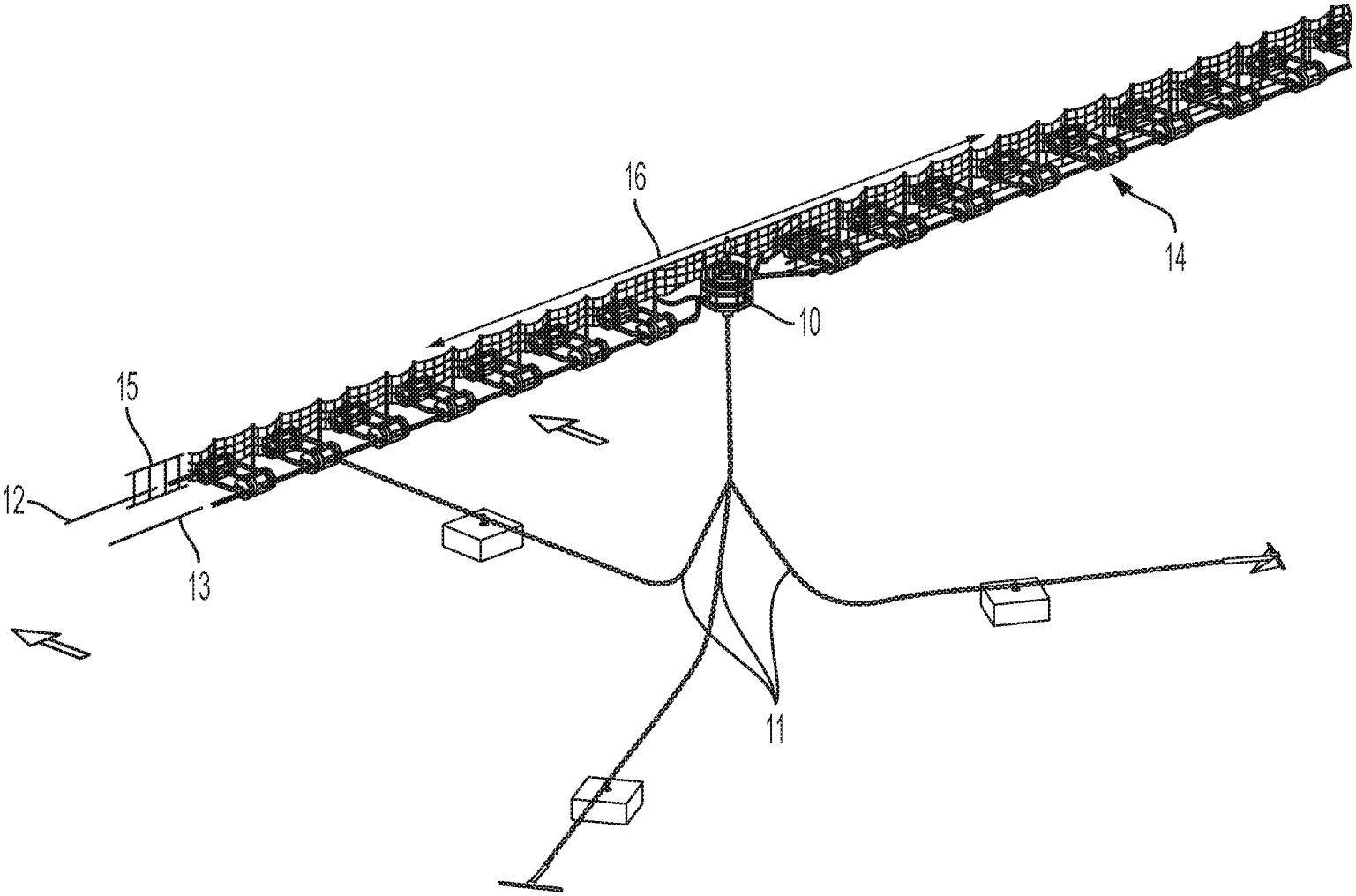
FIG. 1 schematically illustrates a floating marine barrier according to an embodiment of the present disclosure.

Referring now to FIG. 1, a floating marine barrier system according to an embodiment of the present disclosure is connected to mooring buoys 10, which provide site anchorage locations via one or more anchoring devices 11 at the seabed. The barrier system features two parallel main tension strength members 12, 13 such as lines or ropes, one for the protected side (main rope 12) and one for the threat side (main rope 13), onto which mount at variable spacing a series of frame float module assemblies 14 (also referred to herein as "barrier modules"). Mounted onto these barrier module assemblies 14 is a single compliant impact capture net system 15, centrally situated above the two main ropes 12, 13. The compliant net system 15 is continuous in this embodiment, that is, the impact capture net 15 is continued above and across the mooring connection buoy 10 via a continuous net top line 16. The connections at the mooring buoy 10 enable the marine barrier to also be used as a gate, opened and closed by manual operations. This combination of compliant ropes 12, 13, compliant impact capture net 15, and mooring connection buoys 10 form a complete marine barrier and gate system which can distribute impact and environmental loading throughout flexible compliant components, shown in FIG. 2. It is further noted that the marine barrier system can be scaled in all dimensions to achieve requirements of security, site environmental conditions, and cost.

Referring again to FIG. 2, the function of the disclosed marine barrier elongating in localized areas of the system due to accidental or intentional vessel impact is shown. The penetration distance 17 shown can be considerable, often two or three times the length of the vessel that may impact it. This can result in localized elongation 18 of the system of generally 1% to 4% on the low side to as much as 10%, varying by the amount of kinetic energy of the vessel impact, the elastic response of the main ropes 12, 13, the design of the impact capture net 15, and the amount of the barrier deformed to either side of the impact. See, Table 1 below. This essential requirement is the primary reason for the need for compliant net mountings and similar elastic compliance with the main tension strength elements of the system (in this embodiment main ropes 12, 13).

TABLE 1

Bureau of Reclamation - requirement for Boat Barriers

| Vessel Mass | Vessel Speed | Impact Kinetic Energy | Penetration |
|---|---|---|---|
| 8500 lbs | 40 knots | 601,851 ft-lbs | 32.8 ft |

Figure 2:
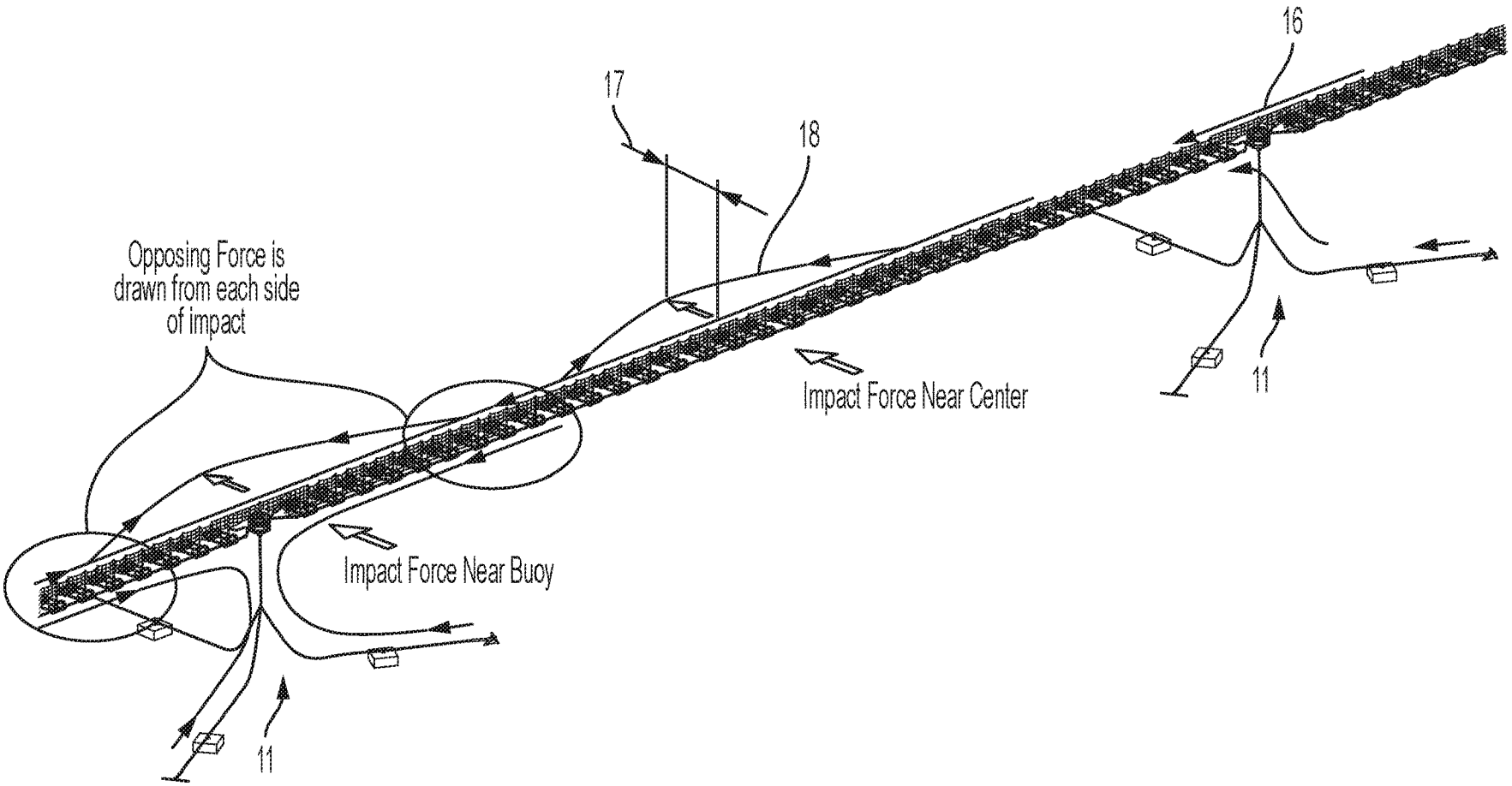
FIG. 2 schematically illustrates the forces of impact and the elongation of the barrier system of FIG. 1 as a reaction to the impact force.

Conventional barrier systems use steel beams, chain, and/or wire rope for the primary tension members, which cannot possibly elongate in similar amounts as any of the available fiber or wire mesh capture net systems. FIG. 2 illustrates the dynamic response of the disclosed marine barrier, where the vessel impact force is matched by the opposing forces drawn from each side of the impact, and extend axially down the barrier potentially to the anchoring spread 11. In conventional marine barrier systems, the load path of impact in the capture net is terminated just prior to a single point barrier connection to mooring buoys. In the disclosed design, the impact forces can be located anywhere along the length of the barrier, with equal forces becoming distributed to both sides of the impact zone via the continuous net top line 16. Furthermore, in conventional barrier systems, in order for the impact capture net to fully elongate, it would have to become separated from the steel structural members, which typically then overturn and are no longer effective for vessel capture, thereby limiting the system and its use to a single event.

Figure 3A:
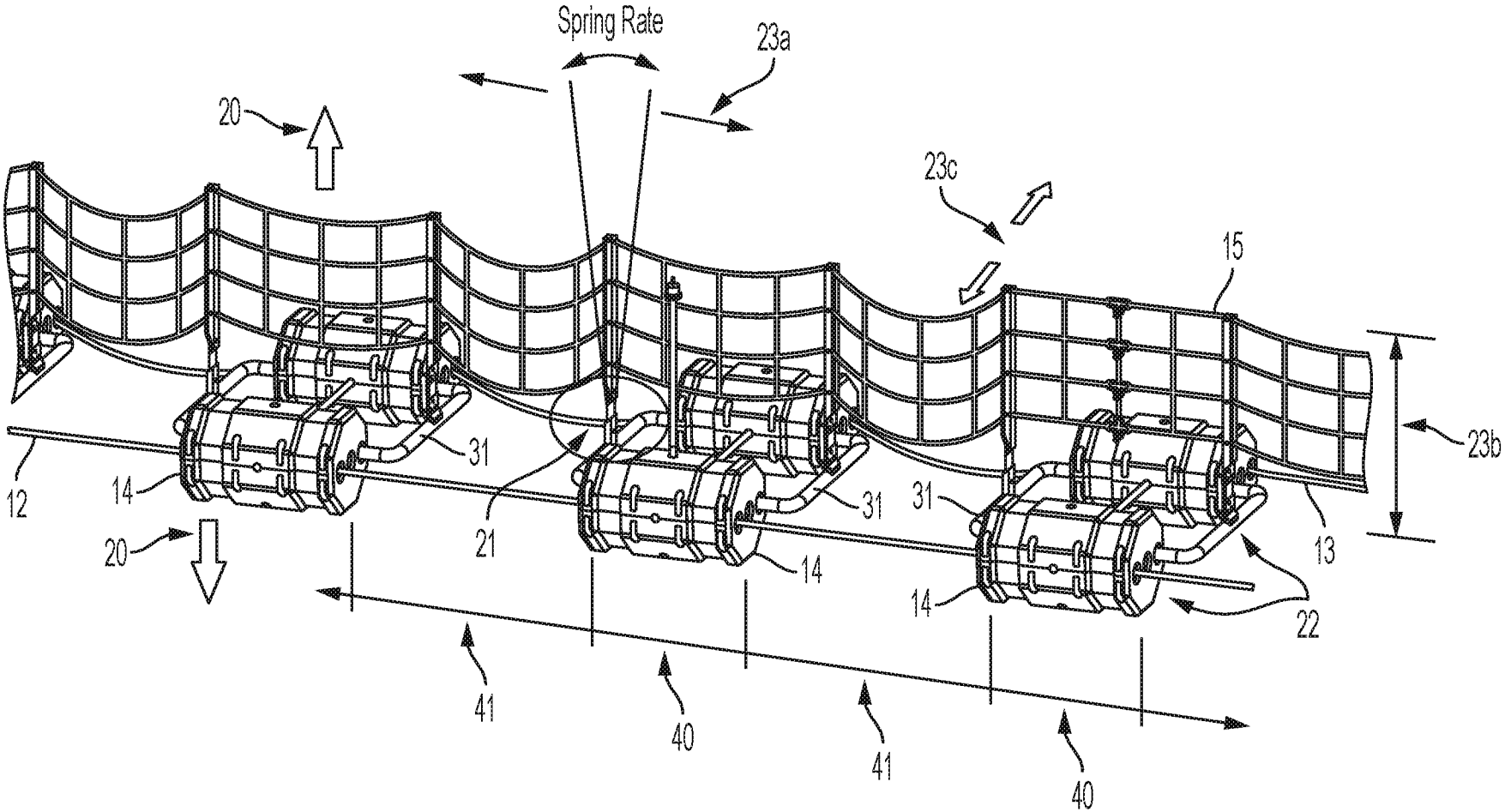
FIGS. 3A-3C schematically show compliant net support posts of barriers according to embodiments of the present disclosure, and the spacing of rigid length to flexible length enabled by the disclosed barrier.
Figure 7:
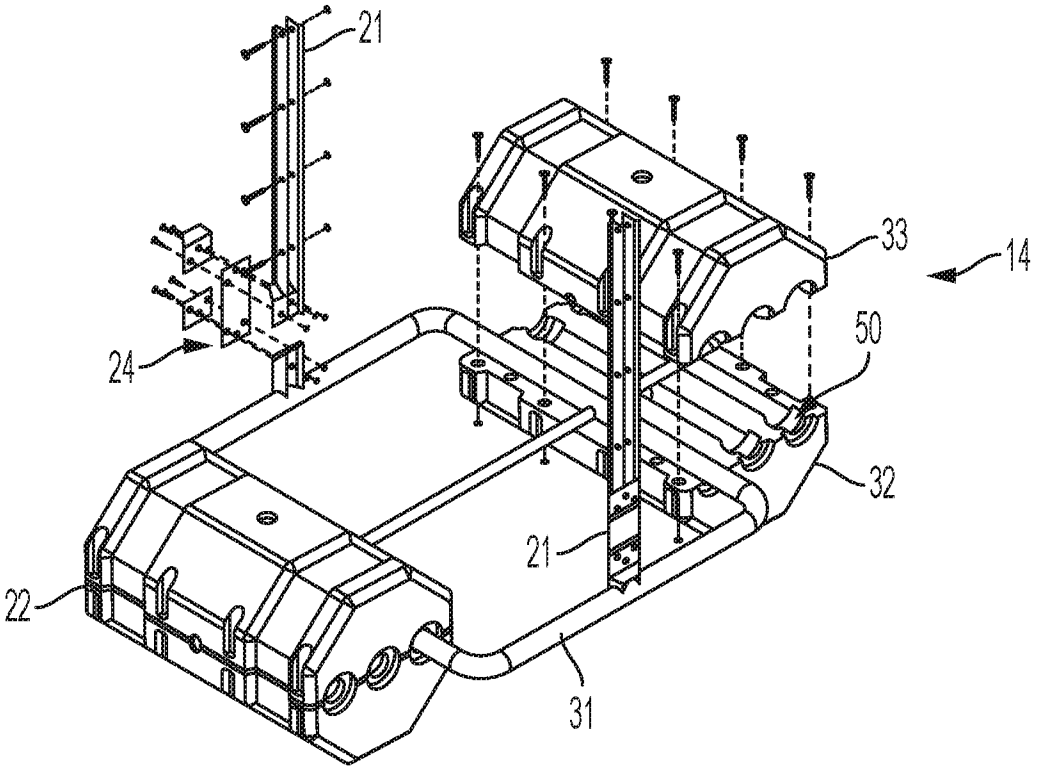
FIG. 7 illustrates a barrier module according to an embodiment of the present disclosure.

Details of the floating marine barrier according to this embodiment are shown in FIG. 3A. The barrier comprises a plurality of the barrier modules 14, each barrier module 14 having first and second parallel flotation devices 22, a supporting framework 31 attached to the flotation devices 22, and a plurality of impact net support posts 21 attached to the supporting framework 31. The barrier module 14 is also shown in FIG. 7. Each barrier module 14 is substantially rigid along its length.

The impact net 15 is attached to each of the support posts 21 of each of the barrier modules 14 and extends between the barrier modules 14 along a longitudinal axis of the barrier from a first end of the barrier to a second end of the barrier. The first and second main tension strength elements 13, 15 are attached to each of the barrier modules 14 and extend between the barrier modules 14 along the longitudinal axis of the barrier from the first end of the barrier to the second end of the barrier to space the barrier modules 14 from each other.

Referring to FIG. 3A, the forces that create the need for compliance in the overall marine barrier system are shown. The site environment will typically have wind, wave, and current conditions that cause a floating marine barrier system to oscillate in the heave direction 20, straining in both directions on the water surface. This combination of three-dimensional deformations will strain the net 15 along its lengthwise axis as the net 15 is increased in height. Thus, in this embodiment of the disclosed barrier the impact net support posts 21 include compliant net support posts, as shown and described in U.S. patent application Ser. No. 17/075,315, published as US 2021/0114700, which is hereby incorporated by reference in its entirety herein.

TABLE 2

Data for design of Compliant Net Post

| Spring Rate (N-m/deg) | Typical Deflection (degrees) | Max Deflection (degrees) | Barrier Net Height (m) | Barrier/ Module Spacing (m) | Significant Wave Environments (m) |
|---|---|---|---|---|---|
| 15-50 N-m/degree | 5-15 deg. | 45 deg. | 0 m-1.2 m | <3 m | 2-3 m |
| 50-200 N-m/degree | 5-15 deg. | 45 deg. | 1.21 m-3 m | <5 m | 2-3.5 m |

The relevant design characteristics of compliant net support posts 21 are based on the variables of net height, wave height, and spacing (pitch) of the posts 21. See, Table 2 above. The frame float module assemblies 14 are rigid bodies, due to their assembled configuration (see, FIG. 7). The spacing of these rigid sections 40 of the barrier creates portions 41 of the lengthwise barrier system that are made up entirely of flexible rope assemblies. In contrast to conventional marine barrier systems which have lengthy rigid sections and short flexible sections, the disclosed design has a roughly equal distribution of rigid and flexible lengths 40, 41. This characteristic enables a desirable wave-following behavior. Additionally, this characteristic is adjustable for site conditions via the embodiments described herein below with reference to FIGS. 5A-5J.

FIG. 3A also illustrates the deflection characteristic of the disclosed barrier due to wave following; that is, the compliant net posts 21 deflect unidirectionally in the lengthwise direction 23*a*, and otherwise has very inelastic response in the vertical direction 23*b* and in the lateral direction 23*c* of impact forces. This is desirable, and is achieved by the use of and orientation of the compliant net post 21's flat plate composite spring 24 attached between a bottom of the support post 21 and the supporting framework 31, as shown in FIG. 7.

Figure 3C:
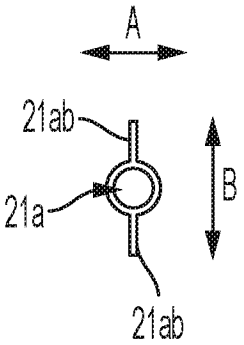
Figure 3B:
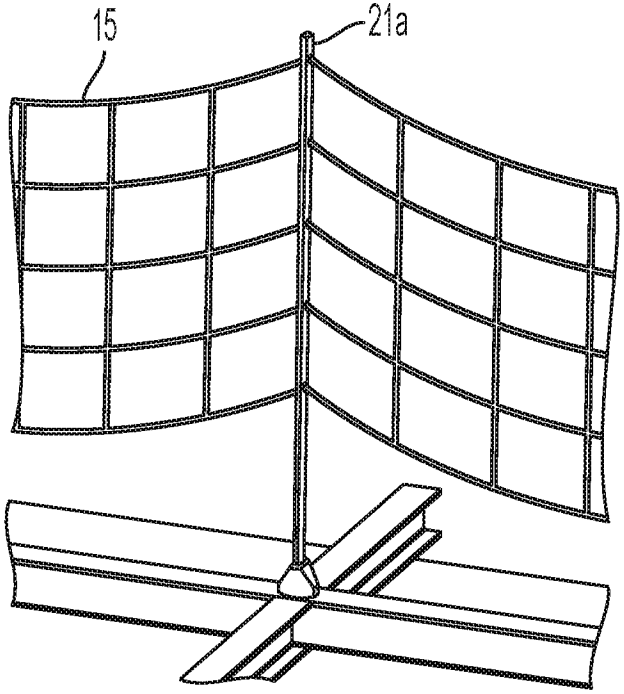

In other embodiments, a compliant net support post 21*a* shown in FIGS. 3B-C is provided which is unidirectionally flexible along substantially its entire length and attached to the supporting framework 31. The geometry of the post 21*a* is shown at FIGS. 3B-C. Post 21*a* has a hollow cross section to provide flexibility in the direction A substantially parallel to the longitudinal axis of the barrier module, and a stiffener plate 21*ab* to render the support post 21*a* substantially inflexible in the direction B substantially perpendicular to the longitudinal axis of the barrier module. The post 21*a*'s cross section is shown primarily circular or round with one or more integrated protrusions 21*ab* that provide stiffening in direction B. However, in other embodiments the post's geometry is a non-symmetric cross section (such as a rectangle, oval, etc).

Figure 4A:
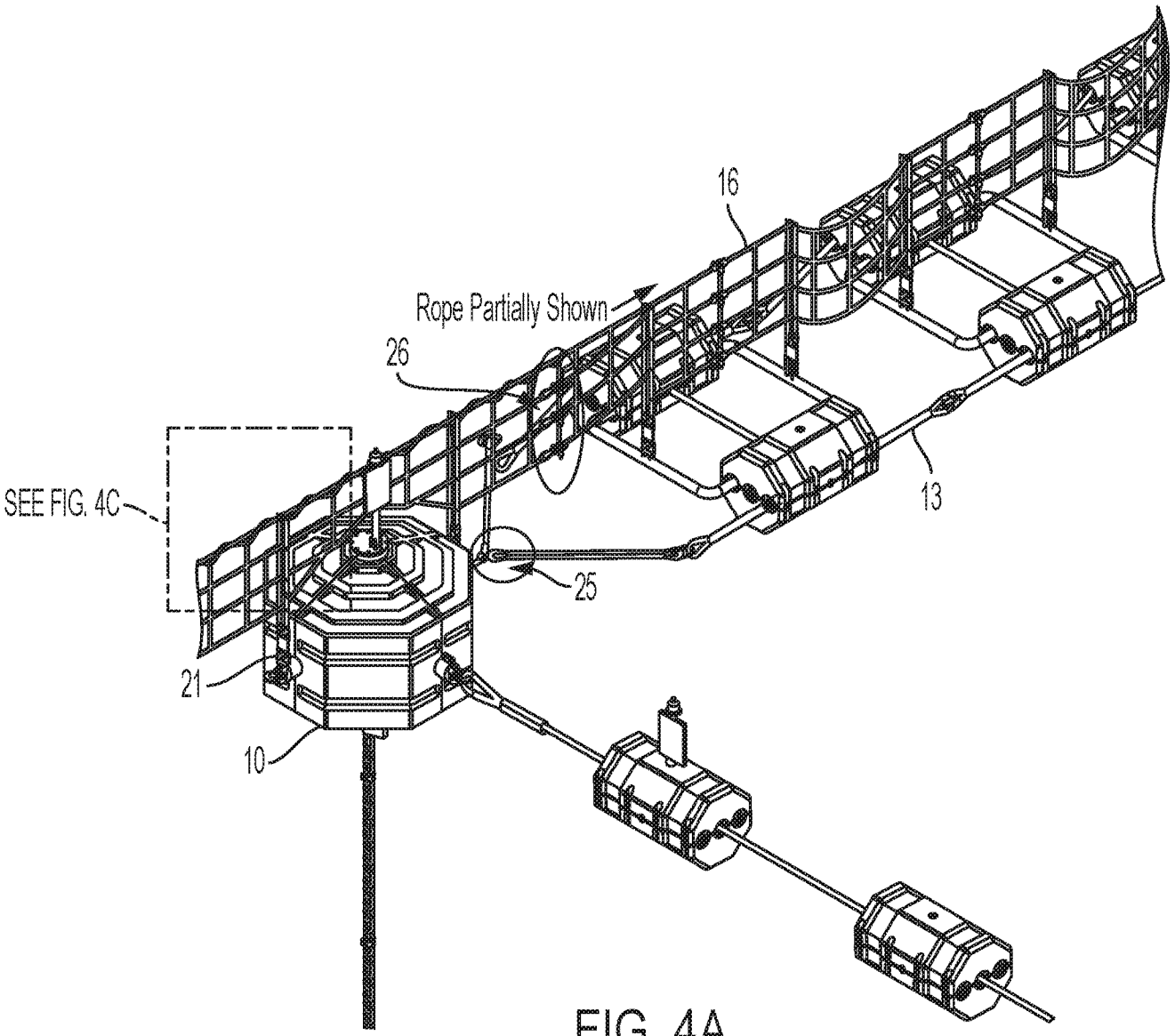
FIGS. 4A-4C schematically illustrate the separate connections of a capture net from connections of main tension strength elements, and other structural details according to embodiments of the present disclosure.
Figure 4B:
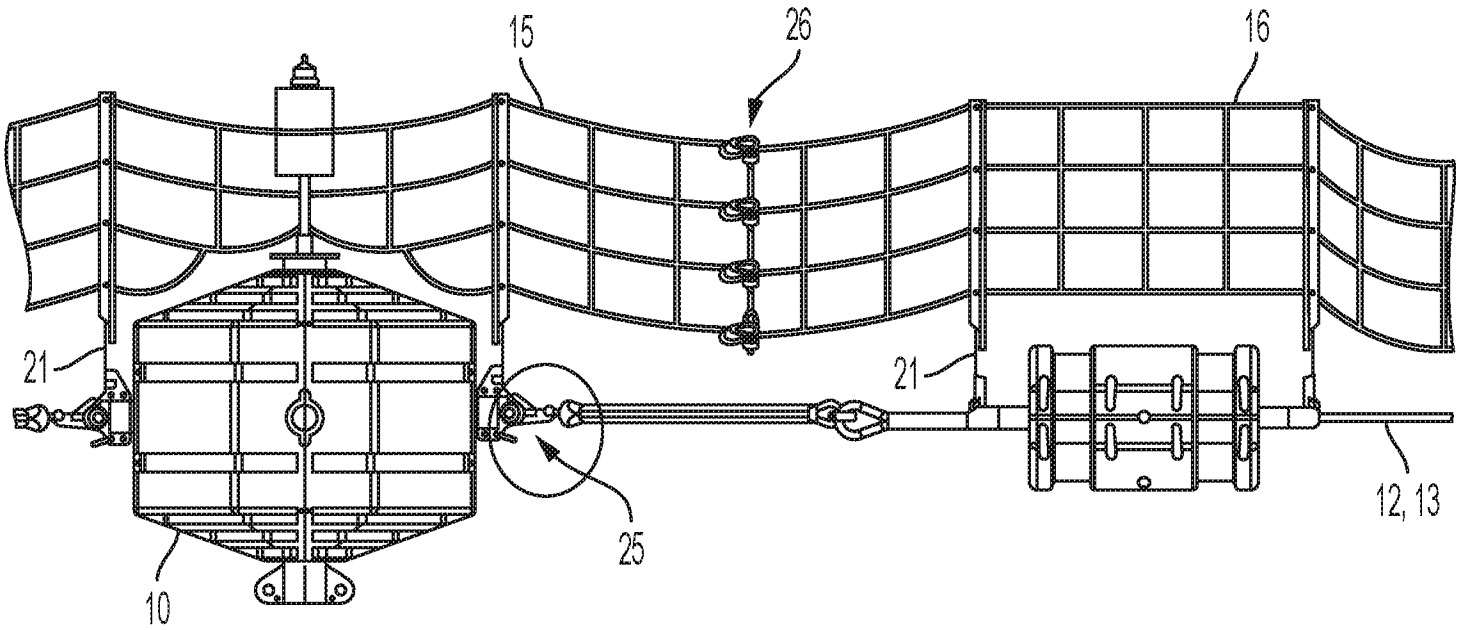

A compliant net support post 21 or 21*a* is attached to the framework 31 at each longitudinal end of each barrier module 14 in certain embodiments, as shown in FIGS. 4B and 7.

Referring to FIGS. 4A and 4B, the disclosed continuous top net line 16 is shown with the separate connections 25 of barrier main tension strength elements 12, 13, and of the capture net 15 connections 26. This clearly shows the mechanical connections and elements enabling the continuous and separate load paths of the disclosed barriers. Net connections 26 can comprise commercially available synthetic shackles, sized to match the capacity of the net ropes, from suppliers such as Yale Cordage of Scarborough, Me., or can comprise marine grade shackles sized to match the capacity of the net rope. The four-side connection mooring buoy 10 features barrier shackle connections on all four sides, enabling 90-degree corner arrangements or the use of strings of barrier at 90 degrees to the perimeter security line, as shown in FIG. 4A. The buoy 10 also comprises the compliant net post 21 to enable directional deflections similar to the nearest barrier-mounted compliant net post 21. The barrier rope connection 25 can comprise a commercially available tamper resistant load release clamp, such as model TR-10 available from MacMillan Design, Gig Harbor, Wash.

Figure 4C:
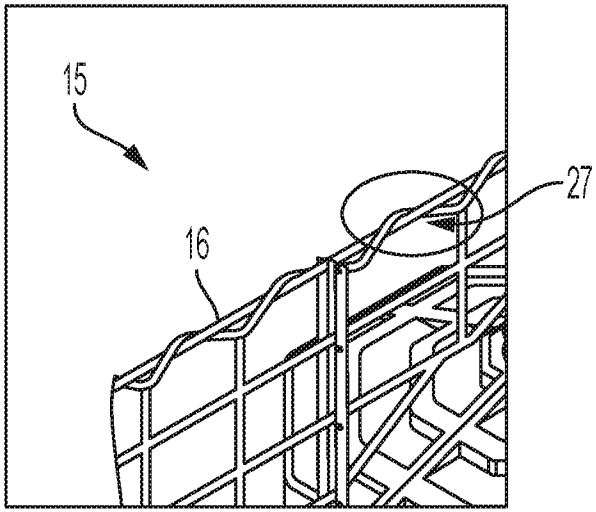

In addition to the nominal continuous top net line 16 of FIG. 2, in certain embodiments an optional additional wrap around rope line 27 is added to the system, sized to have the same tenacity and elasticity as the rope of the net 15. See, FIG. 4C. Testing and analysis indicates that, during impact, the impact capture net 15 top line 16 receives the highest loads at the knots or splice locations of vertical net ropes. The additional wrapped top line 27 increases the factor of safety in the net design by eliminating interruptions and strength reduction of line 16 resulting from knots or splices of the vertical net elements.

Moreover, both knots and splices, such as net connections 26, reduce the capacity of each rope in the net. Wrap-around rope 27 is designed to augment the capacity of the net 15 at the top net line 16. The feature of wrapping the line 27 to attach it to the net 15, and not compromising it with knots or splices, enables full capacity of that line 27. Additionally, wrapping the additional wrap-around rope line 27 through each bay of the net 15 and underneath each top line net grommet 29 (described herein below) ensures the remaining parts of the net 15 are connected to it if the top rope 16 of the net fails during a severe impact.

FIGS. 5A-F illustrates the feature of adjustable positioning of the barrier modules 14 within the length of the barrier, which provides the ability to position or adjust the module spacing of the barrier modules 14, thereby altering the compliant behavior of the system to match wave environments of each individual site where these systems are deployed. The benefit of this feature is that the same mechanical components of the barrier system are simply relocated relative to each other on the main tension strength elements 12, 13, and thereby achieve a wide variety of compliant performance without requiring custom length main frame members or custom flexible members, as is typical with conventional marine barriers. Referring to Table 2 above, the position dimensions of floats, listed as "Barrier/Module Spacing" (shown as ref. num. 42 in FIG. 5A), are less than 3 meters and less than 5 meters in certain embodiments.

Figure 5A:
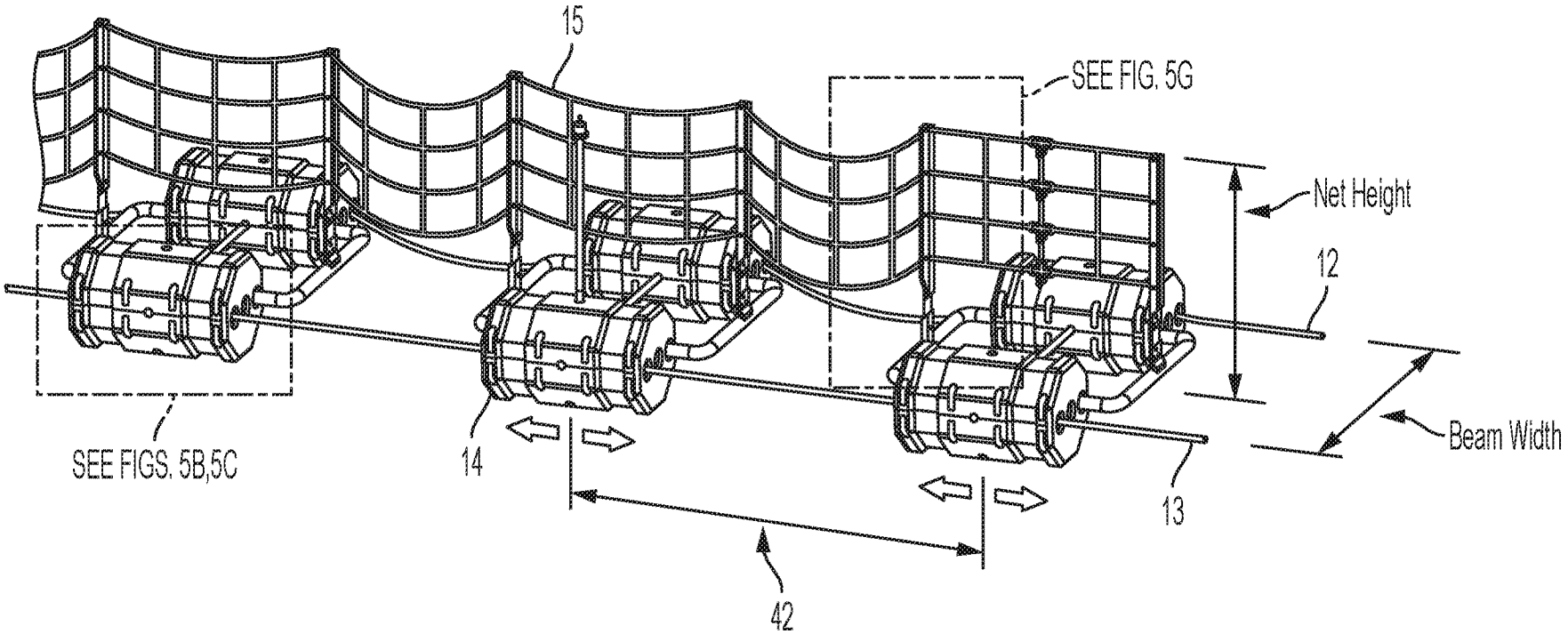
FIGS. 5A-5F schematically show modular flotation units and means for attaching the main tension strength elements thereto according to embodiments of the present disclosure.
Figure 5B:
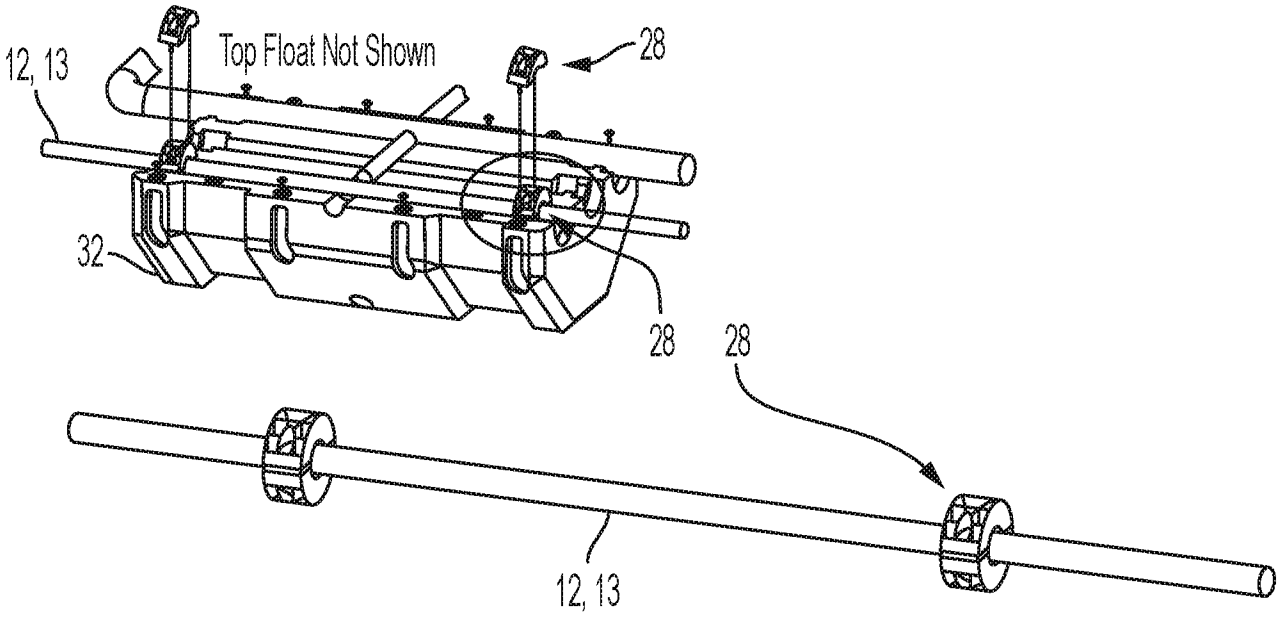
Figure 5C:
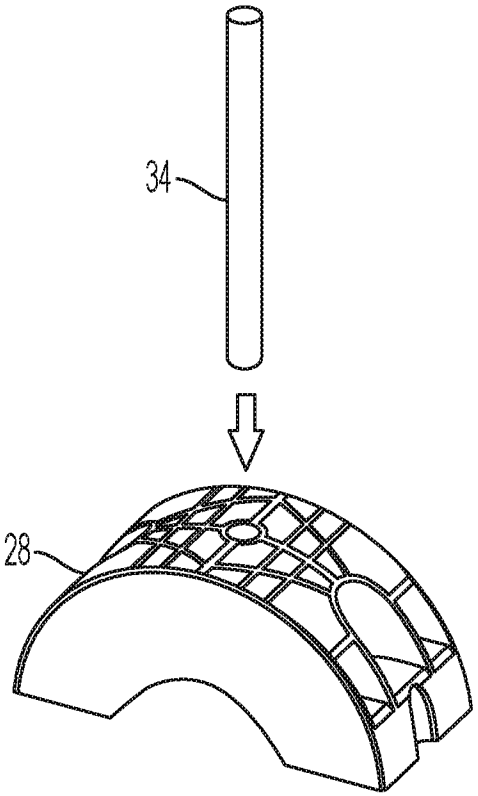
Figure 5D:
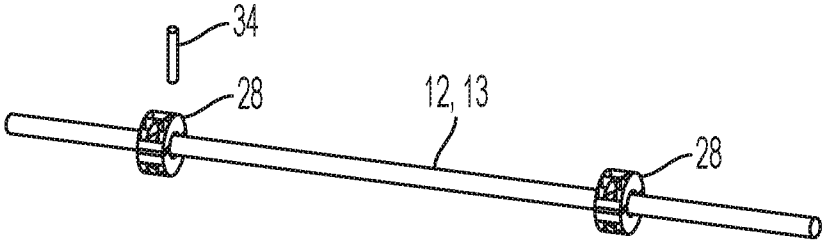

As shown in FIGS. 5B-D, rope clamps 28 of a split clamp design are provided to grip the main tension strength elements 12,13 by pressure. In this embodiment there are two rope clamps 28 per main tension strength line 12, 13 for each float 22. The disclosed clamp 28 also includes a pass-through hole 90 degrees to the line length, enabling an optional pin 34 to pierce the line 12, 13 and fix the rope clamp 28 in double shear location to the main line 12 or 13.

Referring now to FIG. 7, each barrier module 14 comprises two floats 22, which are each comprised of a lower float 32 which may include flotation and ballast weights, and an upper float 33, which when bolted together act like a clamp around the net supporting frame 31. The frame 31 can comprise stainless or galvanized steel pipe, or a bonded composite part. Bolting the two half upper 33 and lower 32 floats together also clamps the float assembly 22 onto the main tension strength lines 12, 13 by sandwiching the rope clamps 28 into tight fitting pockets 50 on the inside of the floats 32, 33.

Figure 5F:
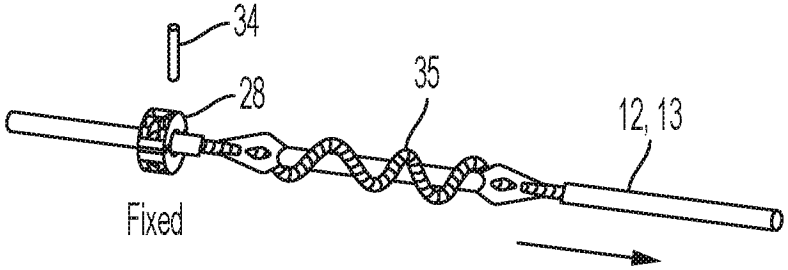
Figure 5E:
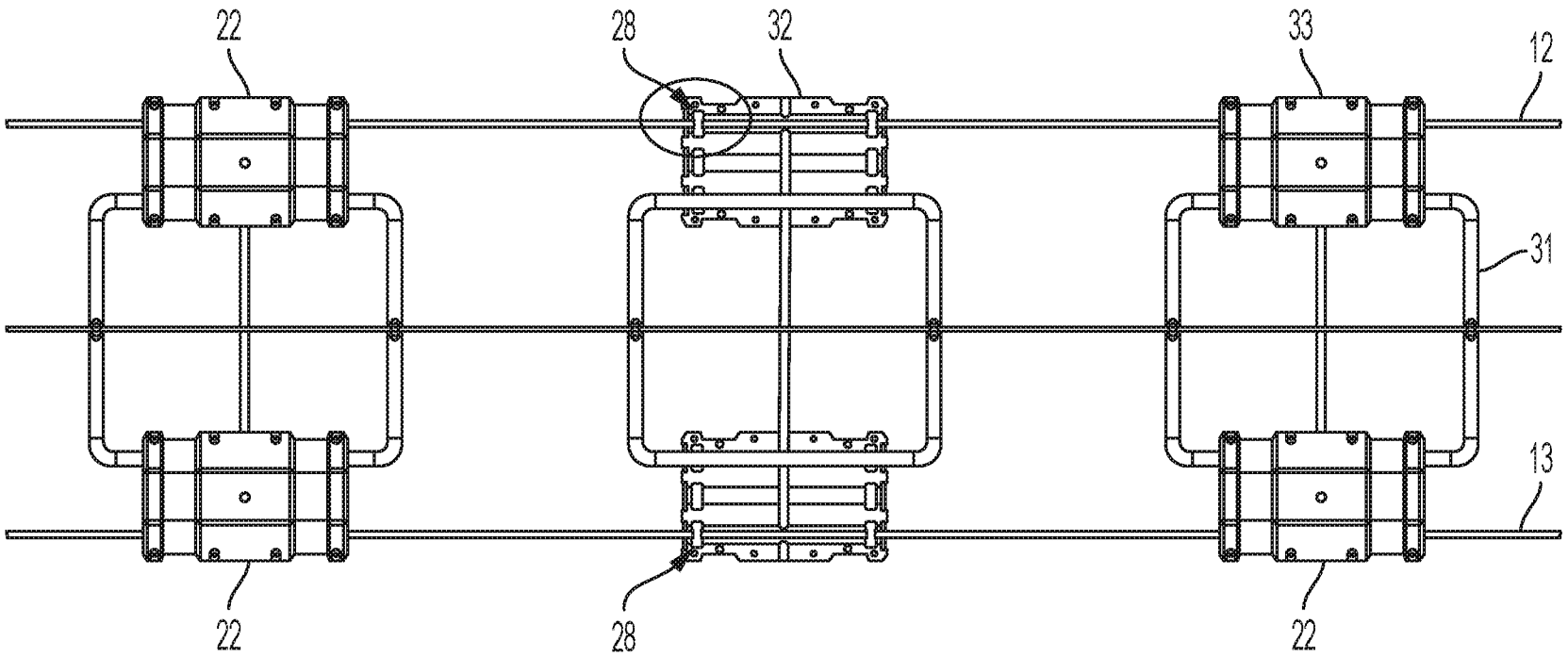

The plan view of FIG. 5E shows all four clamps 28 used per barrier module assembly 14. FIG. 5F illustrates an additional embodiment of the main line 12, 13, where the line is fixed with one rope clamp 28 per float 22, and inside the volume of the float passageway, the main line 12, 13 is wrapped multiple times around a rubber shock absorber 35, similar to commercially available dock line snubbers. This embodiment can further extend the elastic range of the main lines 12, 13.

Figure 5H:
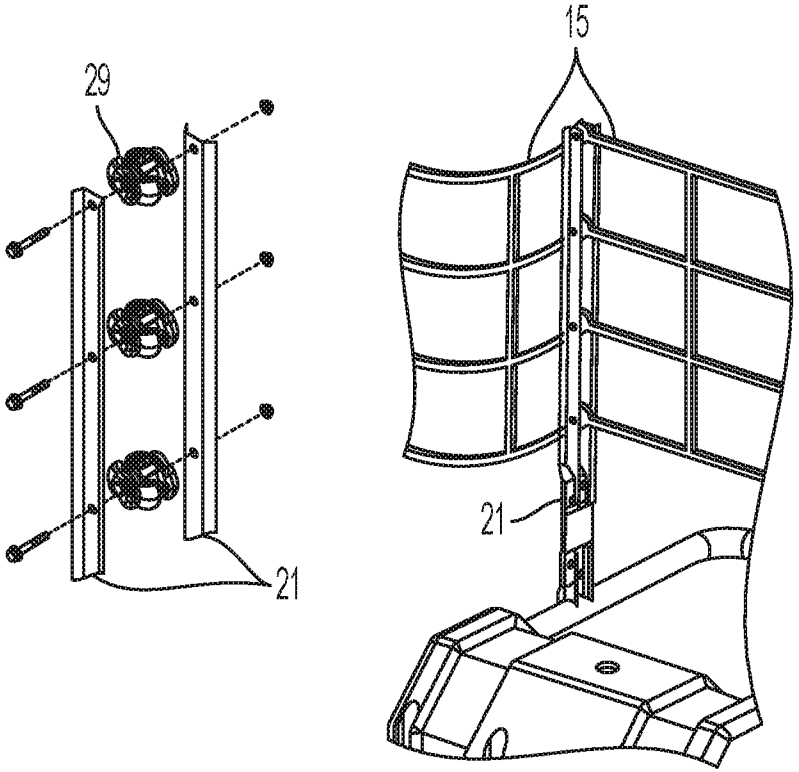
FIGS. 5G-5J schematically show net mounting grommets and their uses according to an embodiment of the present disclosure.
Figure 5G:
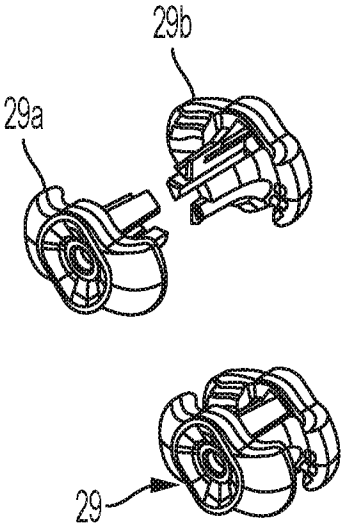

FIGS. 5G-5H show an arrangement to attach the impact capture net 15 to the barrier modules 14. The disclosed net mounting grommets 29 are split into two parts 29*a-b*, and snap together to pass through the center of each horizontal rope used in the net 15. Tests have determined that the net grommets 29 do not appreciably reduce the tensile capacity of the net rope. The net grommets 29 are located at each net support post 21 for each horizontal rope in the net 15, forming a grid pattern to secure the net 15 to the posts 21. Additionally, wrapping the additional wrap-around rope line 27 through each bay of the net 15 and underneath each top line net grommet 29 ensures the remaining parts of the net 15 are connected to it if the top rope 16 of the net fails during a severe impact.

Figure 5I:
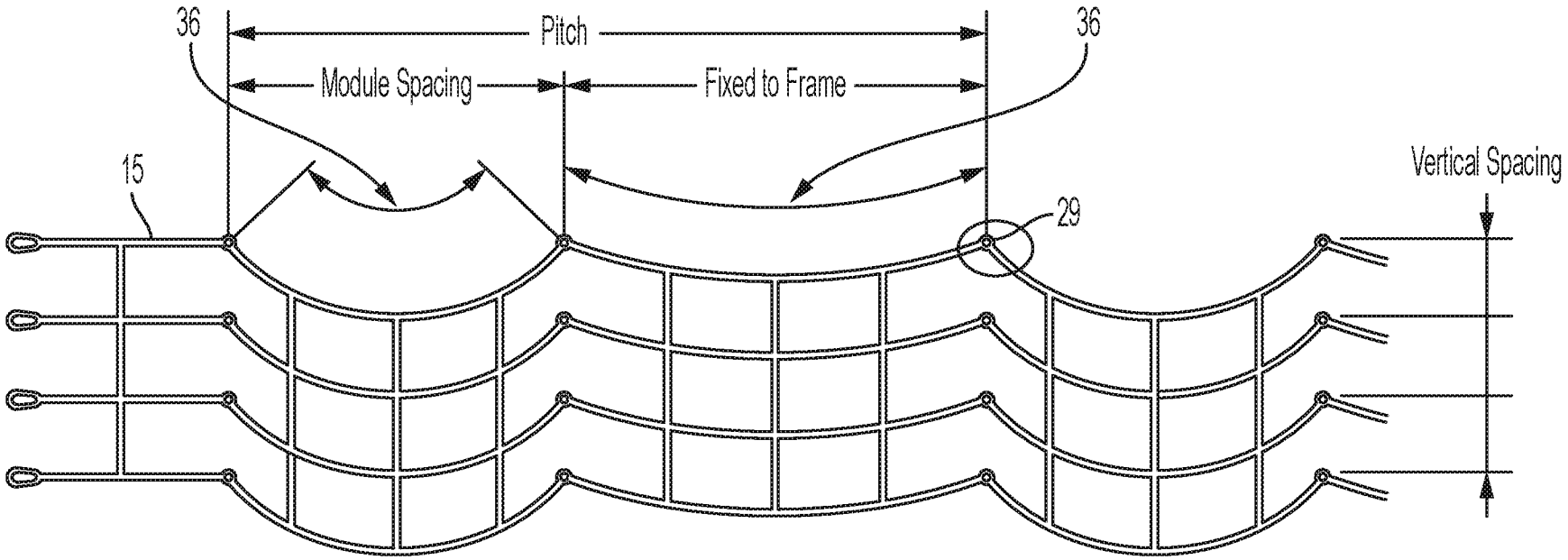
Figure 5J:
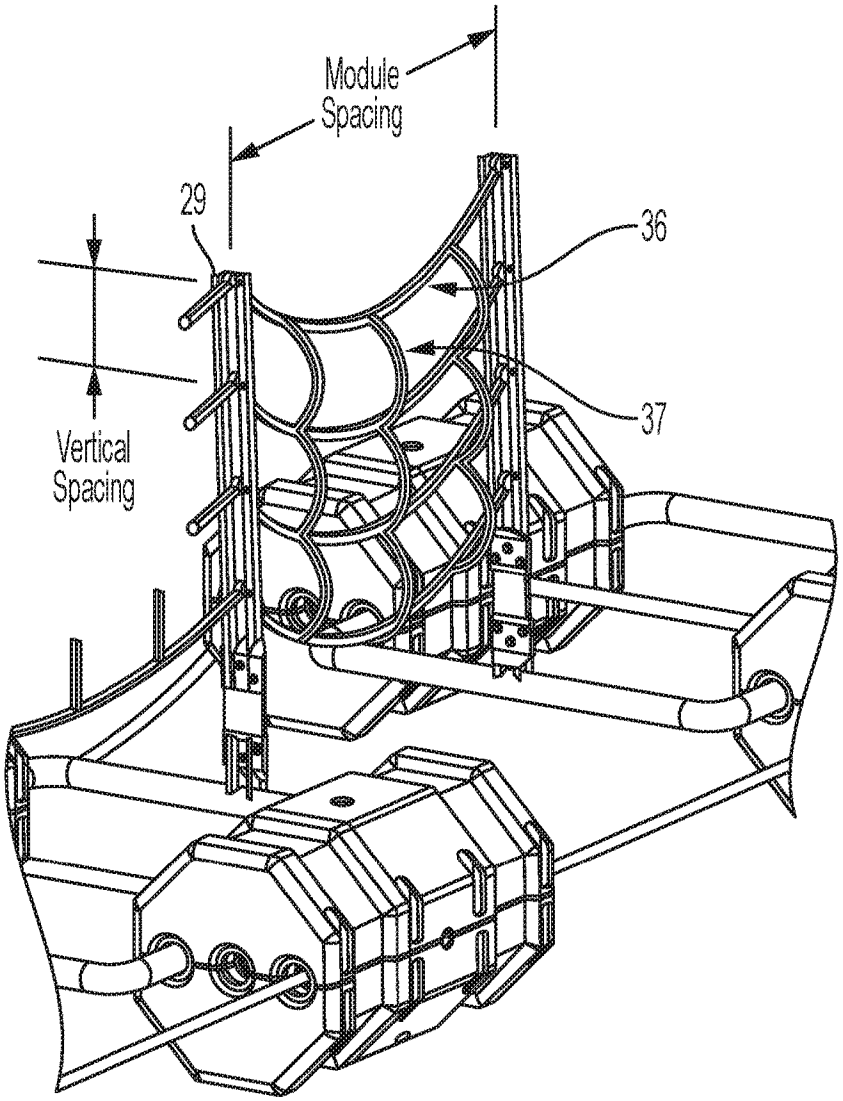

FIGS. 5I and 5J illustrate that the benefit of the net grommet button 29 is the ability to fix how the impact capture net 15 hangs on the net posts 21; in particular, to create slack from the arc length of the net in the horizontal direction 36 and the vertical direction 37. The slack in each direction has an effect on the performance, and a novel aspect of the design is that the tautness of the net 15 can be controlled this way. An advantage of this disclosed design is potentially increased elastic capture performance as the net rope has more slack to absorb the force. The vertical slack 37 is not normally a design alterable feature in conventional impact nets.

The impact capture nets 15 are built with knots or splices that fix the net into a mesh grid, intended to distribute an impact load outward into connected horizontal and vertical ropes of the net 15. One impact capture net embodiment utilizes polyester twelve-strand rope for horizontal lines with a modulus of elasticity of 4.64 GPa, while vertical net lines are smaller size but equal capacity Dyneema (or equivalent) twelve-strand rope, where the outer top and bottom connections of horizontal and vertical ropes are made with splices, and the center intersections are knotted.

Figure 6:
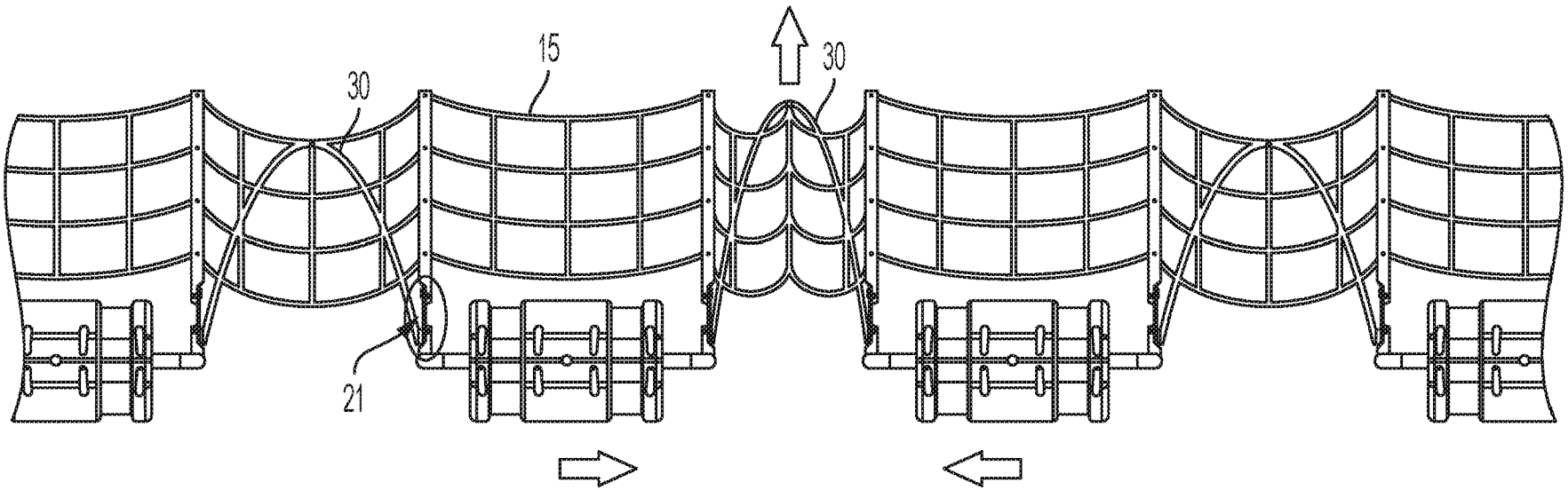
FIG. 6 illustrates a spring pole net support according to an embodiment of the present disclosure.

FIG. 6 illustrates an embodiment having an additional net support spring pole 30. The flexible pole 30 is designed to raise the height of the center of the impact capture net 15 where the arrangement or environment might allow the net to sag below a desirable predetermined height. The spring pole 30 is fully flexible in all directions, allowing for all extremes of motion between the barrier modules 14. The spring pole 30 operates independently of the compliant net post 21. The spring pole 30 comprises a fiberglass-epoxy flexible rod, limited to sufficient flexibility and range of motion to support the impact capture net 15, but not designed to withstand an impact. Suitable commercially available composite spring rod is available from similar suppliers to the composite net post spring 24.

Figure 8:
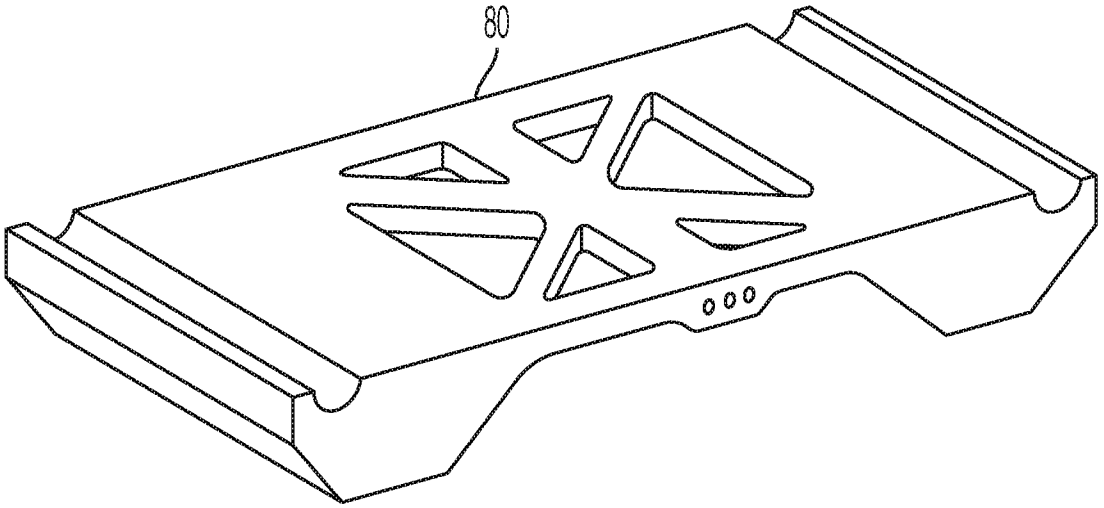
FIG. 8 illustrates a single-piece barrier frame and float according to an embodiment of the present disclosure.

Further embodiments of this system include the use of frame and flotation components of similar geometric configuration made of different materials such as polyethylene (high density polyethylene), thermoformed plastics, injection molded plastics and ferrous materials. In addition, FIG. 8 shows that the base framework 31 and float 22 combination can be made of a single component 80, which when combined with a second inverted component, forms the existing frame/float combination of each barrier module 14.

Figure 9:
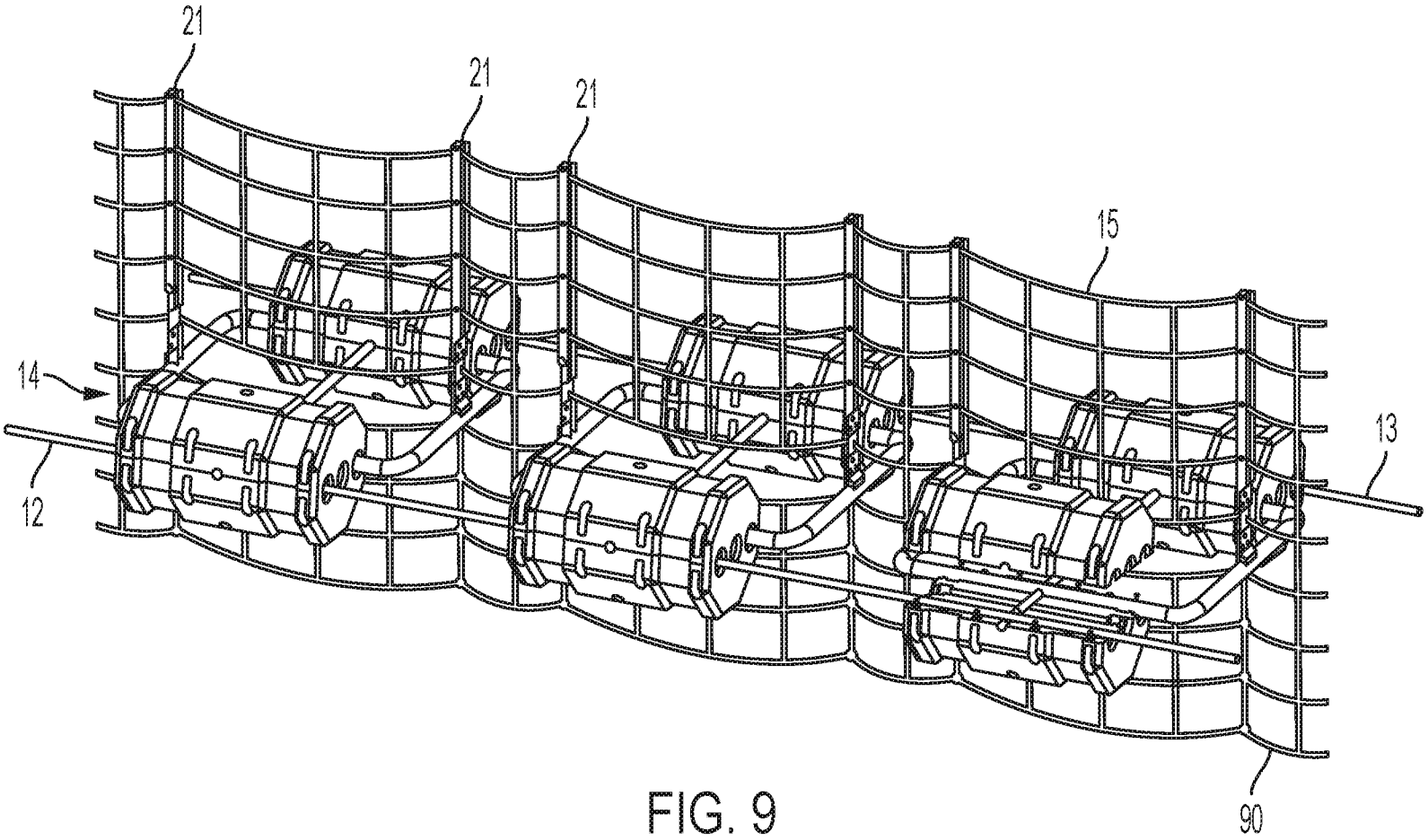
FIG. 9 illustrates a barrier having a subsurface net according to an embodiment of the present disclosure.

In further embodiments such as shown in FIG. 9, the barrier system includes a subsurface net 90 to be used to entangle/capture floating debris floating mines, surface and subsurface propelled devices (such as autonomous vehicles, both surface and subsurface) and remotely controlled operated vehicles (ROV's). The subsurface net 90 can be a mirror image of the above water impact net 15, or sized to select site specific requirements. The net 90 can be made of polymer fibers (nylon, polypropylene, etc), aramid (Kevlar, Dyneema), stainless steel, brass, fiber optics, etc which may or may not be covered in antifouling paints or coatings.

Mentat available at www.mscsoftware.com was employed to perform a dynamic, transient large strain analysis, which is required for this type of multi-physics impact model. Marc is a powerful, general-purpose, nonlinear finite element analysis solution to accurately simulate system behavior under static, dynamic, and multi-physics loading scenarios.

The first step was to construct the impact vessel body in the software. The impact event was simulated with a rigid body vessel using a conservative approach that assumed all energy was transferred to the barrier and no damage to the vessel would occur. Next, a 100-meter length of the barrier was constructed having geometric and material characteristics as those discussed herein. The barrier was properly discretized (using between 11,102-15,774 elements and 10,109-14,277 nodes—depending upon the simulation). The numerical model also incorporated all the barrier's critical structural components to ensure an accurate representation of the barrier.

Figure 10:
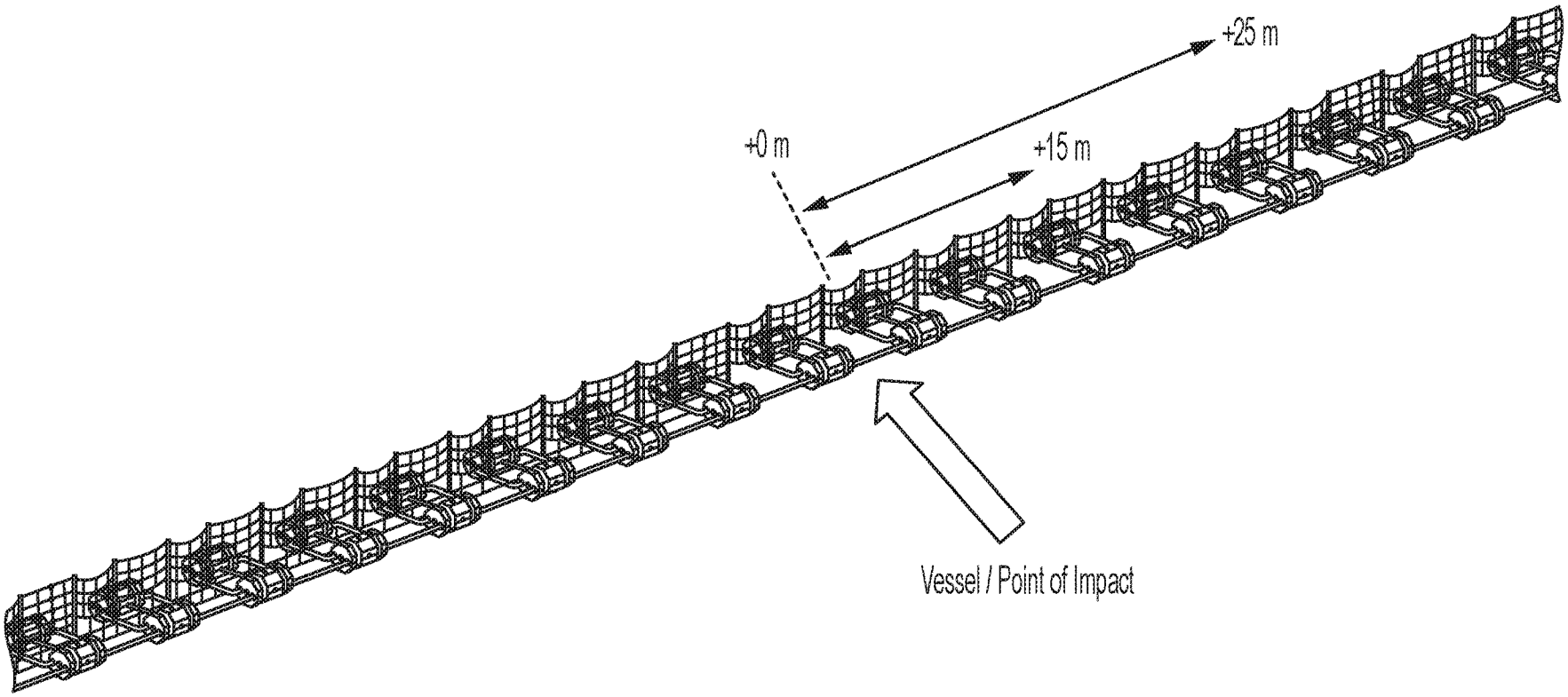
FIGS. 10 and 11 illustrate a barrier according to an embodiment of the present disclosure when it is subject to an impact by a vessel.

The proper gravitational, buoyancy, fluid dynamic (both fluid drag and added mass) boundary conditions were specified to ensure an accurate representation of the barrier on the air-water interface. See, FIG. 10. Then, three different simulations were analyzed: (1) a barrier with nets 15 and main tension strength lines 12, 13 made of polymers, (2) a barrier with a net 15 made of polymer and lines 12, 13 made of stainless steel, and (3) a barrier with a net 15 made of stainless steel and lines 12, 13 made of polymers. As an example, typical modulus of elasticity values for the load bearing lines (main tension lines 12, 13 and nets 15) have modulus of elasticity values between 4.64-8.00 GPa. For reference, the stainless steel wire is approximately 40 times more stiff than the polymer line of similar cross-sectional areas. These combinations of components present the benefits of having a system of similar elastic behaviors versus one having components of very different behaviors.

Figure 11:
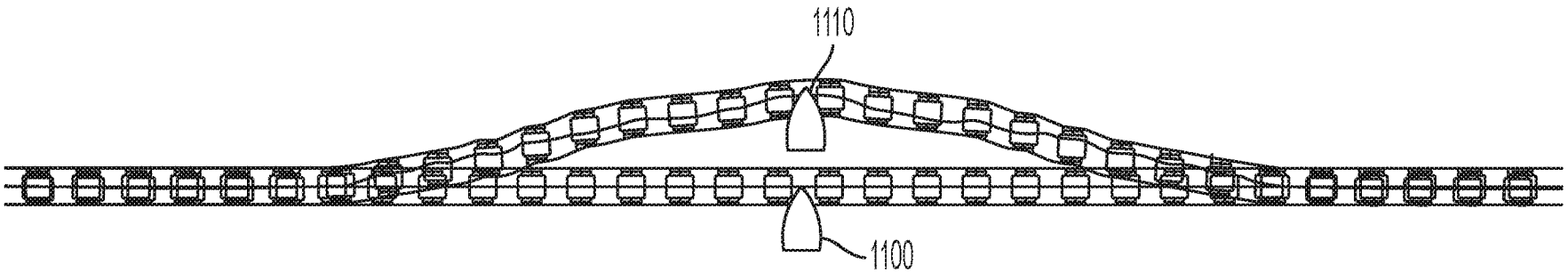

The simulations were performed and the following data was processed: maximum barrier displacement, front line tension at the point of impact and 15 and 25 meters away from the point of impact (see, FIG. 10), and the sum of the horizontal line net tension at similar locations. The results of the analysis are shown in Table 3, and the deformed system is shown in FIG. 11, where the undeformed barrier and vessel are shown as ref. num. 1100, and the deformed barrier and vessel are shown as ref. num. 1110. Stiffness is an example of a trait of elasticity and is defined as the Modulus of Elasticity multiplied by the cross-sectional area of the component.

TABLE 3

Sensitivity Analysis Results of Barriers Having Different Elasticities
Sensitivity analysis results of barriers having different elasticities.

| Barrier Configuration | | | Relative | Relative Front | | | Relative | | |
|---|---|---|---|---|---|---|---|---|---|
| | Line | Net | Vessel | Line Tensions | | | Net Tensions[b] | | |
| Model | Stiffness | Stiffness | Displacement | 0 m[a] | +15 m[a] | +25 m[a] | 0 m[a] | +15 m[a] | +25 m[a] |
| Baseline | 1× | 1× | — | — | — | — | — | — | — |
| Increased Line Stiffness | 40× | 1× | −53% | +310% | +1996% | +1626% | +40% | +7% | +30% |
| Increased Net Stiffness | 1× | 40× | −25% | +151% | +559% | +599% | +21% | +160% | +246% |

[a]Measured from point of impact, along the axis of the barrier
[b]Net tension are the sum of th maximum horizontal net member loads found during the analysis In show the criticality of matching the elasticity of system components to each other, a sensitivity analysis was conducted. The well-known software program MSC Marc/

As seen in Table 3, increased line and/or net component stiffness reduces the vessel displacement; that is, the distance the vessel travels after impacting the barrier's impact net. This is expected, as a stiffer component will not elongate as much as a more compliant component. Thus, the deformation when components having less elasticity are introduced is reduced. Inversely, however, it is clear that the tensions throughout the barrier are increased, sometimes significantly, regardless of which component was simulated to be less pliable. In addition, it can be shown that the difference in elasticity does not reduce system tensions in the more compliant member. Rather, once a barrier has a difference in load bearing component elasticity, both the rigid and compliant subsystems will experience more forces, loads, and/or stresses.

For example, for the simulation where the front line (i.e., main tension strength line 13) stiffness was increased to 40 times the stiffness of the baseline model, not only does the front line experience more loads (as expected), but the net—even though it is still compliant—experiences more forces both at the point of impact and along its length. Similarity, when the net components are simulated to be stiffer and the front line is more compliant, one sees a similar system response.

These results confirm that having a barrier system with similar elasticity in its net and main tension strength elements provides several advantages, such as optimized load distribution and barrier response. In addition, the wear on these components will be decreased, which will help reduce maintenance and replacement costs of these components.

While this disclosure has been described in conjunction with a number of embodiments, it is evident that many alternatives, modifications and variations would be or are apparent to those of ordinary skill in the applicable arts. Accordingly, applicants intend to embrace all such alternatives, modifications, equivalents and variations that are within the spirit and scope of this disclosure.

What is claimed is:

1. A floating marine barrier comprising:

a plurality of barrier modules, each barrier module having a first flotation device, a supporting framework attached to the first flotation device, and a plurality of impact net support posts attached to the supporting framework;

an impact net attached to each of the support posts of each of the barrier modules and extending between the barrier modules along a longitudinal axis of the barrier from a first end of the barrier to a second end of the barrier; and a first main tension strength element attached to each of the barrier modules and extending between the barrier modules along the longitudinal axis of the barrier from the first end of the barrier to the second end of the barrier to space the barrier modules from each other;

wherein the impact net has a first elasticity, and the first main tension strength element has a second elasticity which is substantially equal to the first elasticity;

wherein when the barrier is floating in a body of water and a moving vessel impacts the impact net, the impact net deflects to transfer a force of the impact to at least one of the net support posts and to one or more of the barrier modules, which in turn engages the first main tension strength element and the water to transfer the force of the impact to the main tension strength element and the water to arrest the motion of the vessel;

wherein at least one of the impact net support posts of each of the barrier modules is a compliant net support post having a unidirectionally elastic spring element attached between a bottom of the support post and the supporting framework; and wherein the spring element is movable in a direction substantially parallel to the longitudinal axis of the barrier module, and substantially inflexible in a direction substantially perpendicular to the longitudinal axis of the barrier module, such that when the moving vessel impacts the impact net, the impact net deflects to transfer a force of the impact to at the least one compliant net support posts and the elastic spring element remains substantially stationary relative to the at least one net support post.

2. The floating marine barrier of claim 1, wherein each of the barrier modules comprises a second flotation device arranged substantially parallel to the first flotation device and attached to the framework such that the barrier module is substantially rigid along its length;

wherein the barrier comprises a second main tension strength element having the second elasticity attached to each of the barrier modules, and extending between the barrier modules along the longitudinal axis of the barrier from the first end of the barrier to the second end of the barrier; and wherein the net support posts and the impact net are centrally disposed above the first and second main tension strength elements.

3. The floating marine barrier of claim 2, wherein the first and second main tension strength elements each comprise a line comprising a polymer or a metal.

4. The floating marine barrier of claim 3, wherein the first and second main tension strength elements are adjustably attachable to the barrier modules such that a distance between adjacent ones of the barrier modules is variable.

5. The floating marine barrier of claim 3, wherein the first and second main tension strength elements are attached to the barrier modules such that the barrier modules are substantially equally spaced from each other along the longitudinal axis of the barrier.

6. The floating marine barrier of claim 1, wherein one of the compliant net support posts is attached to the framework at each of first and second ends of each barrier module.

7. The floating marine barrier of claim 1, wherein the impact net comprises a continuous top line extending along the longitudinal axis of the barrier from the first end of the barrier to the second end of the barrier.

8. The floating marine barrier of claim 7, including an additional continuous rope line wrapped around and attached to the impact net continuous top line, the additional rope line having an elasticity substantially equal to the first elasticity.

9. The floating marine barrier of claim 1, wherein the impact net is attached to two adjacent ones of the net support posts with a predetermined slack.

10. The floating marine barrier of claim 1, wherein the impact net comprises a plurality of horizontal ropes, and one or more of the impact net support posts each comprise a plurality of grommets corresponding to the horizontal ropes for retaining the impact net to the support post;

wherein the grommets each have a pair of interlocking halves which pass through one of the horizontal ropes of the impact net and attach to one of the net support posts.

11. The floating marine barrier of claim 10, wherein the grommets are for securing the impact net to two adjacent ones of the net support posts with a predetermined slack.

12. The floating marine barrier of claim 1, comprising an elastic net support spring pole attached to one of the net support posts of each of two adjacent ones of the barrier modules, for supporting the impact net at a minimum predetermined height above the body of water.

13. The floating marine barrier of claim 1, comprising a subsurface net attached to the framework of each of the barrier modules and extending below a surface of the body of water.

14. A floating marine barrier comprising:

a plurality of barrier modules, each barrier module having a first flotation device, a supporting framework attached to the first flotation device, and a plurality of impact net support posts attached to the supporting framework;

an impact net attached to each of the support posts of each of the barrier modules and extending between the barrier modules along a longitudinal axis of the barrier from a first end of the barrier to a second end of the barrier; and a first main tension strength element attached to each of the barrier modules and extending between the barrier modules along the longitudinal axis of the barrier from the first end of the barrier to the second end of the barrier to space the barrier modules from each other;

wherein the impact net has a first elasticity, and the first main tension strength element has a second elasticity which is substantially equal to the first elasticity;

wherein when the barrier is floating in a body of water and a moving vessel impacts the impact net, the impact net deflects to transfer a force of the impact to at least one of the net support posts and to one or more of the barrier modules, which in turn engages the first main tension strength element and the water to transfer the force of the impact to the main tension strength element and the water to arrest the motion of the vessel;

wherein at least one of the impact net support posts of each of the barrier modules is a compliant net support post which is flexible along substantially its entire length and attached to the supporting framework; and wherein the compliant net support post is flexible in a direction substantially parallel to the longitudinal axis of the barrier module, and substantially inflexible in a direction substantially perpendicular to the longitudinal axis of the barrier module, such that when the moving vessel impacts the impact net, the impact net deflects to transfer a force of the impact to at the least one compliant net support posts and the elastic spring element remains substantially stationary relative to the at least one net support post.

15. The floating marine barrier of claim 14, wherein one of the compliant net support posts is attached to the framework at each of first and second ends of each barrier module.

16. A floating marine barrier comprising:

a plurality of barrier modules, each barrier module having a first flotation device, a supporting framework attached to the first flotation device, and a plurality of impact net support posts attached to the supporting framework;

an impact net attached to each of the support posts of each of the barrier modules and extending between the barrier modules along a longitudinal axis of the barrier from a first end of the barrier to a second end of the barrier; and a first main tension strength element attached to each of the barrier modules and extending between the barrier modules along the longitudinal axis of the barrier from the first end of the barrier to the second end of the barrier to space the barrier modules from each other;

wherein the impact net has a first elasticity, and the first main tension strength element has a second elasticity which is substantially equal to the first elasticity;

wherein when the barrier is floating in a body of water and a moving vessel impacts the impact net, the impact net deflects to transfer a force of the impact to at least one of the net support posts and to one or more of the barrier modules, which in turn engages the first main tension strength element and the water to transfer the force of the impact to the main tension strength element and the water to arrest the motion of the vessel;

wherein each of the barrier modules comprises a second flotation device arranged substantially parallel to the first flotation device and attached to the framework such that the barrier module is substantially rigid along its length;

wherein the barrier comprises a second main tension strength element having the second elasticity attached to each of the barrier modules, and extending between the barrier modules along the longitudinal axis of the barrier from the first end of the barrier to the second end of the barrier;

wherein the net support posts and the impact net are centrally disposed above the first and second main tension strength elements;

wherein the first and second main tension strength elements each comprise a line comprising a polymer or a metal;

wherein the first and second main tension strength elements are adjustably attachable to the barrier modules such that a distance between adjacent ones of the barrier modules is variable;

wherein the first and second main tension strength elements each pass through one of the first and second flotation devices of each barrier module; and wherein each of the first and second flotation device comprises a clamp for rigidly attaching to one of the first and second main tension strength elements and for engaging a retaining pocket of the respective flotation device to attach the one of the main tension strength elements to the barrier module.

17. The floating marine barrier of claim 16, wherein the clamp is for gripping the one of the main tension strength elements by pressure.

18. The floating marine barrier of claim 17, wherein each of the first and second flotation devices comprises two of the clamps and two of the retaining pockets to attach the one of the main tension strength elements to the barrier module.

19. The floating marine barrier of claim 17, wherein each of the first and second flotation devices comprises exactly one of the clamps and one of the retaining pockets, and an internal compartment for housing an elastic shock absorber around which the one of the main tension strength elements is wrapped.

20. The floating marine barrier of claim 17, wherein each of the first and second flotation devices comprises an upper float and a lower float, the upper and lower floats being engageable to surround and retain a portion of the framework to the respective flotation device, and to form the retaining pocket.

* * * * *